US009877627B2

(12) United States Patent
Schultink et al.

(10) Patent No.: US 9,877,627 B2
(45) Date of Patent: Jan. 30, 2018

(54) ECOLOGICALLY EFFICIENT VACUUMING DEVICE

(75) Inventors: Jan Schultink, Eksel (BE); Ralf Sauer, Overpelt (BE)

(73) Assignee: Eurofilters N.V., Overpelt (BE)

( * ) Notice: Subject to any disclaimer, the term of this patent is extended or adjusted under 35 U.S.C. 154(b) by 1122 days.

(21) Appl. No.: 14/006,593

(22) PCT Filed: Mar. 21, 2012

(86) PCT No.: PCT/EP2012/001240
§ 371 (c)(1),
(2), (4) Date: Dec. 3, 2013

(87) PCT Pub. No.: WO2012/126616
PCT Pub. Date: Sep. 27, 2012

(65) Prior Publication Data

US 2014/0075713 A1 Mar. 20, 2014

(30) Foreign Application Priority Data

Mar. 22, 2011 (EP) ..... 11002361
Aug. 31, 2011 (EP) ..... 11007088

(51) Int. Cl.
*A47L 9/14* (2006.01)

(52) U.S. Cl.
CPC ..... *A47L 9/14* (2013.01); *A47L 9/1427* (2013.01)

(58) Field of Classification Search
CPC ..... A47L 9/14
See application file for complete search history.

(56) References Cited

U.S. PATENT DOCUMENTS 1,815,242 A 7/1931 Davidson
1,859,861 A * 5/1932 Ballou ..... A47L 9/14 55/368

(Continued)

FOREIGN PATENT DOCUMENTS

DE 27 34 051 A1 2/1979
DE 20 2005 000 917 U1 3/2005

(Continued)

OTHER PUBLICATIONS

International Search Report dated Jun. 29, 2012 for International Application No. PCT/EP2012/001240.

(Continued)

*Primary Examiner* — Larry E Waggle, Jr.
*Assistant Examiner* — Henry Hong
(74) *Attorney, Agent, or Firm* — Brinks Gilson & Lione

(57) ABSTRACT

The invention relates to a vacuum cleaning apparatus comprising a vacuum cleaner and a filter bag. When using an empty filter bag, said vacuum cleaning apparatus has a quality factor $Q^{W}_{un}$ (defined as $Q^{W}_{un}=(h^{saug}_{un}/h^{fbar}_{un})\times\psi$ where $h^{saug}_{un}$ is the vacuum, in [kPa], according to EN 60312, of the vacuum cleaning apparatus with an empty filter bag, $h^{fbar}_{un}$ is the vacuum, in [kPa], in the filter bag-holding compartment with an empty filter bag, and ψ is the filtration efficiency, in [%], of the filter bag material) of more than 25, preferably more than 30, and/or when using a partly filled filter bag, the vacuum cleaning apparatus has a quality factor $Q^{W}_{teil}$ (defined as $Q^{W}_{teil}=(h^{saug}_{teil}/h^{fbar}_{teil})\times\psi$ where $h^{saug}_{teil}$ is the vacuum, in [kPa], according to EN 60312, of the vacuum cleaning apparatus with a partly filled filter bag, $h^{fbar}_{teil}$ is the vacuum, in [kPa], in the filter bag-holding compartment with a partly filled filter bag, and ψ is the filtration efficiency, in [%], of the filter bag material (Continued)

of more than 13, preferably more than 15, especially preferably more than 17.

19 Claims, 8 Drawing Sheets

(56) References Cited

U.S. PATENT DOCUMENTS

| | | | | |
|---|---|---|---|---|
| 4,514,200 | A * | 4/1985 | Sumerau | A47L 9/14 383/904 |
| 5,748,853 | A | 5/1998 | Deschenes | |
| 2011/0162335 | A1* | 7/2011 | Frei | A47L 5/36 55/372 |
| 2013/0055900 | A1* | 3/2013 | Sauer | A47L 9/14 96/135 |

FOREIGN PATENT DOCUMENTS

| | | | |
|---|---|---|---|
| DE | 20 2006 016 303 | U1 | 1/2007 |
| DE | 20 2006 016 304 | U1 | 1/2007 |
| DE | 10 2005 054 903 | B3 | 3/2007 |
| DE | 20 2006 019 108 | U1 | 3/2007 |
| DE | 20 2007 010 692 | | 11/2007 |
| DE | 20 2008 007 717 | U1 | 9/2008 |
| DE | 20 2008 016300 | U1 | 2/2009 |
| DE | 20 2008 016 669 | U1 | 4/2009 |
| DE | 10 2007 060 747 | | 6/2009 |
| DE | 10 2008 006 769 | A1 | 8/2009 |
| DE | 20 2009 002 970 | U1 | 12/2009 |
| DE | 20 2010 013 156 | U1 | 3/2011 |
| EP | 0 338 479 | A1 | 10/1989 |
| EP | 0 367 276 | A1 | 5/1990 |
| EP | 0 479 609 | A2 | 4/1992 |
| EP | 0 651 965 | A1 | 5/1995 |
| EP | 0 960 645 | | 12/1999 |
| EP | 1 787 560 | | 5/2007 |
| EP | 1 804 635 | | 7/2007 |
| EP | 1 915 938 | | 4/2008 |
| EP | 1 997 417 | A2 | 12/2008 |
| EP | 2 012 640 | | 1/2009 |
| EP | 2 263 507 | A1 | 12/2010 |
| EP | 2 366 319 | A1 | 9/2011 |
| EP | 2 366 320 | A1 | 9/2011 |
| EP | 2 366 321 | A1 | 9/2011 |
| EP | 2 428 151 | A1 | 3/2012 |
| WO | WO 00/00269 | A1 | 1/2000 |
| WO | WO 2005/060807 | | 7/2005 |
| WO | WO 2007/134734 | A1 | 11/2007 |
| WO | WO 2010/000453 | | 1/2010 |

OTHER PUBLICATIONS

British Standard EN 60312; "Vacuum cleaners for household use—Methods of measuring the performance"; English version; European Committee for Electrotechnical Standardization; Feb. 2008; 80 pages.

* cited by examiner

Fig. 4b
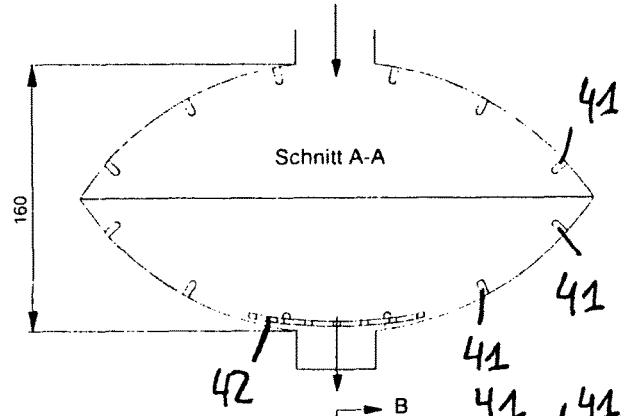
Fig. 4c
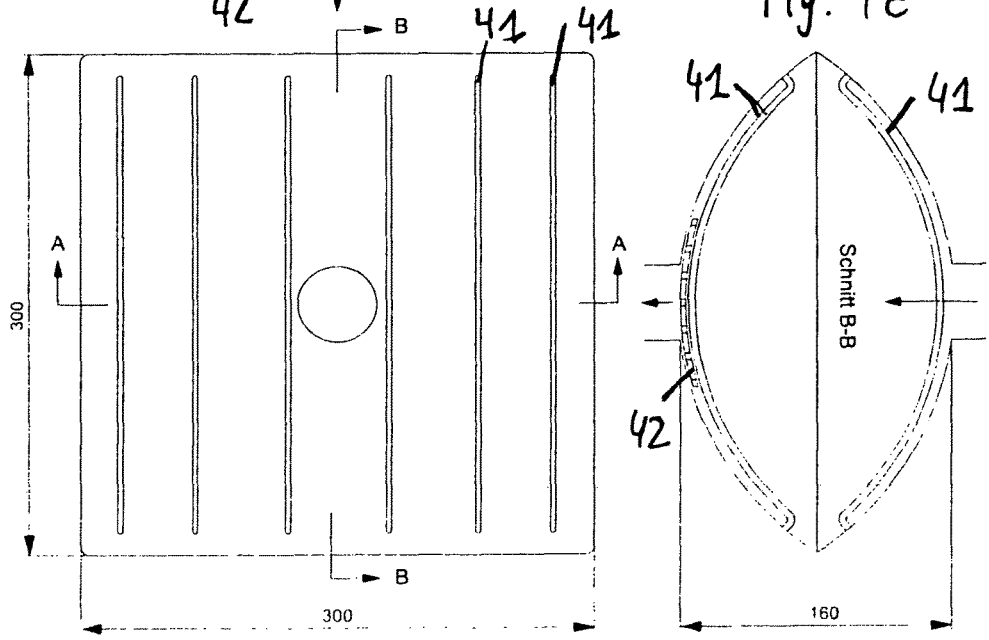
Fig. 4a

Fig. 5b
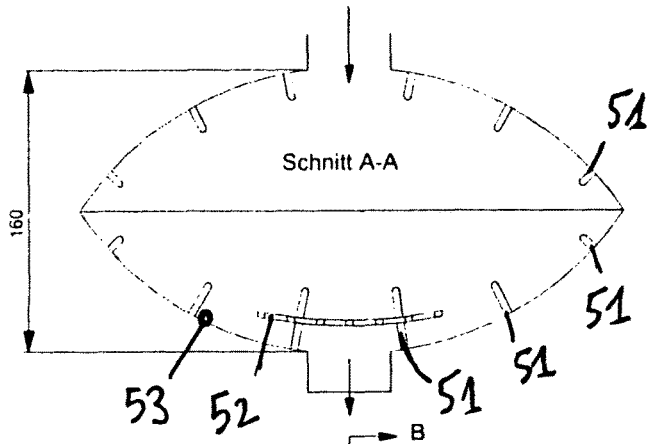
Fig. 5c
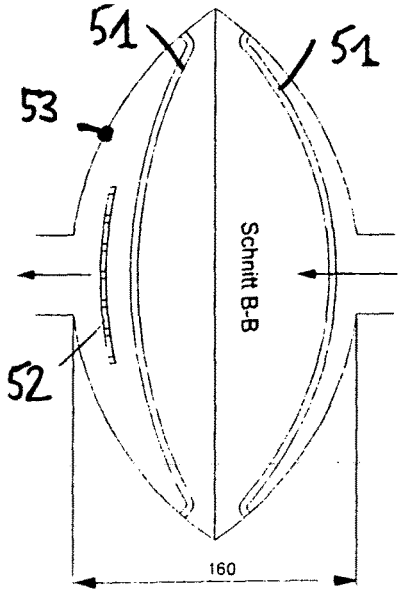
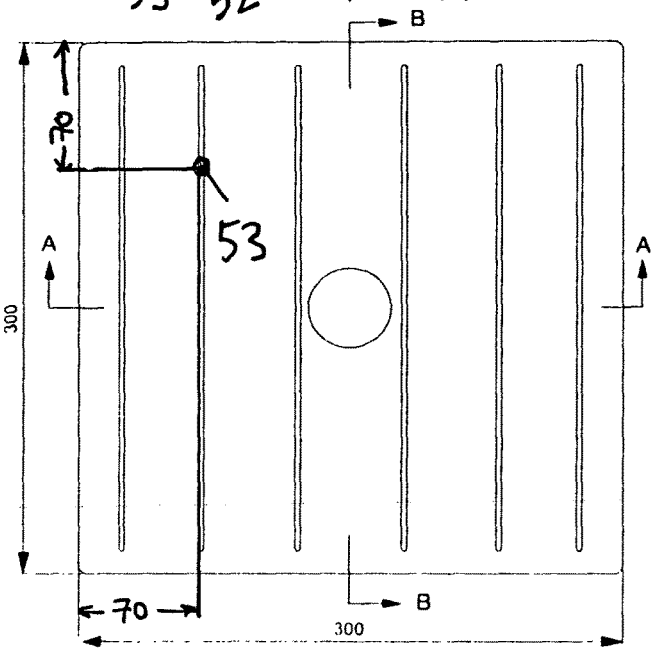
Fig. 5a

ECOLOGICALLY EFFICIENT VACUUMING DEVICE

This application claims the benefit under 35 U.S.C. § 371 of International Application No. PCT/EP2012/001240, filed Mar. 21, 2012, which claims the benefit of European Patent Application No. 11002361.1, filed Mar. 22, 2011, and European Patent Application No. 11007088.5, filed Aug. 31, 2011 which are incorporated by reference herein in their entirety.

FIELD OF THE INVENTION

The invention relates to a vacuum cleaning apparatus with a vacuum cleaner and a filter bag.

Definitions

The following definitions and the following measuring methods are taken as a basis for the description of prior art and the invention. If nothing to the contrary is indicated in the present description, the technical terms used in the field of the invention are used in the sense of the following standard.

EN 60312: In the present document, EN 60312 always designates the standard draft E DIN EN 60312-1:2009-12.

Determination of air data: The air data to which reference is made in the present description, that means in particular vacuum and air flow, are determined analogously to EN 60312, Chapter 5.8. For all measurements, the measuring device as it is described in EN 60312, Chapter 7.2.7, is used for this. Here, the measuring chamber B as described in EN 60312, Chapter 7.2.7.2 was used for all measurements. The measuring chamber and the vacuum cleaners according to prior art were all connected with the original hoses and the original tubes. In case of the device according to the invention, the original hose of the Siemens Z 6.0 extreme power edition device and a tube having a length of 66 cm and an inner diameter of 33.5 mm were used in all embodiments. Since the orifice diameter 8 ($d_0$=40 mm) corresponds to the effective opening surface of an average floor nozzle and thus represents practically relevant conditions, all measurements of the air data were only carried out with this orifice diameter.

Empty and partly filled filter bag: Here, measurements are made on empty filter bags and on partly filled filter bags. A partly filled filter bag is defined as a filter bag that has been filled with 400 g of DMT8 test dust according to EN 60312 (Chapter 5.9.1). Different from the standard, the sucking in of the test dust is not terminated as soon as one of the three conditions mentioned in Chapter 5.9.1.3 is reached for the first time. 400 g of test dust in portions of 50 g is rather always sucked in.

Definition and determination of the vacuum according to EN 60312: The vacuum according to EN 60312 $h^{saug}_{un}$ for an empty filter bag and $h^{saug}_{teil}$ for a partly filled filter bag are defined in the present document as the values according to EN 60312 which are measured with the above measuring device assembly, i.e. measuring chamber B with orifice 8, for the empty and for the partly filled filter bag. The instruments used for measuring the vacuum must meet the requirements according to EN 60312, Chapter 7.2.7.3. The vacuum is measured in [kPa].

Definition and determination of the vacuum in the filter bag-holding compartment: As vacuum in the filter bag-holding compartment $h^{fbar}_{un}$ for an empty filter bag and $h^{fbar}_{teil}$ for a partly filled filter bag, instruments which meet the requirements according to EN 60312, Chapter 7.2.7.3 are used. The vacuum in the filter bag-holding compartment is measured in [kPa]. The place in the filter bag-holding compartment at which the vacuum is measured is located at a point which cannot be covered or obstructed by the filter bag.

Air flow: The air flow $q_{un}$ for the empty and $q_{teil}$ for the partly filled filter bag is determined according to EN 60312, Chapter 7.2.7.2 from the vacuum $h^{saug}_{un}$ for an empty filter bag and $h^{saug}_{teil}$ for a partly filter bag which was measured with the measuring chamber B with the orifice diameter 8. In prior art, this air flow is also often referred to as flow rate or suction air flow.

Electric input power of the motor/fan unit of a vacuum cleaner: The electric input powers $P^{el}_{un}$ and $P^{el}_{teil}$ with an empty or a partly filled filter bag are measured with the measuring devices indicated for measuring electric input powers according to EN 60335, Chapter 7.2.7.3. The electric input power is also measured in [W]. As already results from the term input power of the motor/fan unit, electric power inputs of other components of the vacuum cleaner, for example a power input by an electrically operated brush, are not considered when calculating the electric input power.

Mean power input of the motor/fan unit of a vacuum cleaner: The mean power input of the motor/fan unit of a vacuum cleaner in the sense of the invention results as an arithmetic average from the electric input power of the motor/fan unit with an empty and a partly filled filter bag, measured with orifice 8.

Filtration efficiency: The filtration efficiency in [%] in the sense of the present invention is defined by ψ=100−transmittance [%]. (This must not be confused with the definition also used in prior art according to which the filtration efficiency is defined by: (original concentration−achieved concentration)/original concentration). The filtration efficiency is measured with the TSI filter tester model 8130 at 86 l/min. For generating the NaCl particles, the integrated Salt Aerosol Generator 8118A is used which generates particles of an average particle size of 0.26 μm (so-called mean mass diameter).

Quality factor with an empty filter bag: One criterion for the ecological efficiency of a vacuum cleaning apparatus with a vacuum cleaner and a filter bag is the quality factor $Q^{W}_{un}$ with an empty filter bag. It is defined as:

$$Q^{W}_{un}=(h^{saug}_{un}/h^{fbar}_{un})\times\psi \text{ where}$$

$h^{saug}_{un}$: vacuum according to EN 60312 of the vacuum cleaning apparatus with an empty filter bag in [kPa], $h^{fbar}_{un}$: vacuum in the filter bag-holding compartment with an empty filter bag in [kPa], and ψ: filtration efficiency of the filter bag material in [%]

So, the quality factor $Q^{W}_{un}$ results as a quotient from the vacuum arising in the region of the floor nozzle of a vacuum cleaner, and the vacuum generated in the filter bag-holding compartment directly by the motor/fan unit. This quotient includes the resistance of the filter bag. On the one hand, the pressure loss of the filter material is taken into consideration. On the other hand, the effective filter area, the fit of the filter bag and folding-out of the filter bag are included. This factor is then multiplied by the filtration performance of the filter material to ensure that the high suction power is not achieved due to a poor filtration efficiency, that means a low dust particle retention.

Thus, the quality factor $Q^{W}_{un}$ represents a measure for the conversion of the vacuum generated by the motor/fan unit in the filter bag-holding compartment into the vacuum arising in the region of the floor nozzle due to the resistance of the empty filter bag taking into consideration the filtration efficiency of the material of the filter bag.

Quality factor with a partly filled filter bag: Since the quality factor $Q^{W}_{un}$ decreases as the bag is being filled with dust, the quality factor $Q^{W}_{teil}$ with a partly filled filter bag is used as an additional or alternative criterion for the ecological efficiency of a vacuum cleaning apparatus with a vacuum cleaner and a filter bag. For the determination of this quality factor, an empty filter bag is loaded with 400 g of DMT8 test dust, and then the quality factor is determined in the same manner as with the empty filter bag. This quality factor is accordingly defined as $$Q^{W}_{teil}=(P^{saug}_{teil}/h^{fbar}_{teil})\times\psi \text{ where}$$

$h^{saug}_{teil}$: vacuum according to EN 60312 of the vacuum cleaning apparatus with a partly filled filter bag in [kPa], $h^{fbar}_{teil}$: vacuum in the filter bag-holding compartment with a partly filled filter bag in [kPa], and $\psi$: filtration efficiency of the filter bag material in [%]

Thus, this quality factor $Q^{W}_{teil}$ represents a measure for the conversion of the vacuum generated in the filter bag-holding compartment by the motor/fan unit into the vacuum arising in the region of the floor nozzle due to the resistance of the partly filled filter bag taking into consideration the filtration efficiency of the material of the filter bag.

Flat bag: A flat bag in the sense of the present invention is defined as a filter bag whose filter bag wall is formed from two single layers of filter material of the same area, such that the two single layers are only connected to each other at their peripheral edges (the term same area naturally does not exclude that the two single layers differ in that one of the layers includes an inlet opening).

The connection of the single layers can be realized by a weld or bonded seam along the complete periphery of the two single layers; however, it can also be formed by folding a single layer of filter material about one of its axes of symmetry and welding or bonding the remaining open peripheral edges of the thus formed two partial layers (so-called tubular bag). In such a fabrication, three weld or bonded seams are accordingly required. Two of these seams then form the filter bag edge, the third seam can also form a filter bag edge or else lie on the filter bag surface.

Flat bags in the sense of the present invention can also include so-called gussets. Here, these gussets may be folded out completely. A flat bag with such gussets is shown, for example, in DE 20 2005 000 917 U1 (cf. there FIG. 1 with folded-in gussets and FIG. 3 with folded-out gussets). As an alternative, the gussets can be welded to portions of the peripheral edge. Such a flat bag is shown in DE 10 2008 006 769 A1 (cf. there in particular FIG. 1).

Filter bag with surface pleats: A filter bag whose filter bag wall comprises surface pleats is known per se from prior art, for example from the European patent application 10163463.2 (cf. there in particular FIG. 10a and FIG. 10b or FIG. 11a and FIG. 11b). If the filter bag wall comprises several surface pleats, this material is also referred to as pleated filter material. Such pleated filter bag walls are shown in European patent application 10002964.4.

FIG. 1 and FIG. 2 show a filter bag in a cross-section with a wall each comprising two surface pleats. By such surface pleats, the filter area of the filter bag is enlarged, resulting in a higher dust acceptance capacity of the filter bag with a higher filtration performance and a longer service life (each compared with a filter bag of the same outer dimensions and without surface pleats).

In FIG. 1, a filter bag 1 with a filter bag wall 10 comprising two surface pleats 11 in the form of so-called dovetailed pleats is represented. The filter bag is here represented in a cross-section through the filter bag center. The longitudinal axes of the surface pleats accordingly extend in one plane which in turn extends perpendicularly to the drawing plane, and at their longitudinal ends, the surface pleats pass over into the weld seams of the filter bag extending in parallel to the drawing plane and lying in front of and behind the drawing plane. Thus, the surface pleats can be folded out to the greatest extent in their center. The filter bag is here shown in a state where the surface pleats are already slightly folded out.

In FIG. 2, a filter bag 2 with a filter bag wall 20 comprising two surface pleats 21 in the form of so-called triangular pleats is represented. The filter bag is here represented in a cross-section through the filter bag center. The longitudinal axes of the surface pleats accordingly extend in one plane which in turn extends perpendicularly to the drawing plane, and at their longitudinal ends, the surface pleats pass over into the weld seams of the filter bag extending in parallel to the drawing plane and lying in front of and behind the drawing plane. Thus, the surface pleats can be folded out to the greatest extent in their center. The filter bag is here also shown in a state where the surface pleats are already slightly folded out.

Surface pleats of other shapes are possible besides the surface pleats represented in FIG. 1 and FIG. 2. The fact that the surface pleats extend, in the embodiments according to FIG. 1 and FIG. 2, perpendicularly to a bag edge is not to be understood as a restriction. Of course, the surface pleats can also extend at an angle to the bag edges.

Pleat fixation: The surface pleats are conveniently fixed by strips of a non-woven material inside the bag. FIGS. 3*a* and 3*b* show how pleat fixation for dovetailed pleats can be produced. FIG. 3*a* shows the plan view onto a filter material web 31 comprising the dovetailed pleats, and a non-woven material web 32 lying upon it in this FIG. 3*a*, from which web the non-woven strips employed for pleat fixation are finally formed. From the non-woven material web 32 (which can consist, for example, of a spunbonded fabric with 17 g/m$^2$), rectangular holes 33 of 10×300 mm were punched out. FIG. 3*b* shows the section along line A-A in FIG. 3*a*. One can see from this sectional view that the parts of the non-woven material web, which are employed for pleat fixation, are connected to the filter material web by means of weld lines 34. The non-woven strip that fixes the pleats is drawn in FIG. 3*b* disproportionately bulgy for a better representation. In fact, the non-woven material web 32 lies flatly on the filter material web 31. In FIGS. 3*a* and 3*b*, the distances between the weld points and the distances between the punched holes and the web widths of the filter material web 31 as well as the perforated non-woven material web 32 and the length of the weld points 34 are furthermore stated in [mm].

Two layers of this filter material consisting of the two webs 31 and 32 are now superimposed and welded over a width of 290 mm to form a filter bag. The remaining material of about 20 mm at each edge is cut off.

Diffusers in the vacuum cleaner filter bag: Diffusers in the vacuum cleaner filter bag are known from prior art. The variants employed here are described in EP 2 263 507 A1.

Filter material CS50: Laminate with the following structure seen from the outflow side: spunbonded fabric 17 g/m$^2$, netting 8 g/m$^2$/meltblown 40 g/m$^2$/spunbonded fabric 17 g/m$^2$/PP staple fibers 50 up to 60 g/m$^2$/carded staple fiber non-woven 22 g/m$^2$. A detailed description of the PP staple fiber layer can be found in EP 1 795 247 A1. This filter material can be bought from the owner of the property right.

SMS92: Laminate with the following structure seen from the outflow side: spunbonded fabric 35 g/m$^2$/40 g/m$^2$ meltblown/spunbonded fabric 17 g/m$^2$. The meltblown and the spunbonded fabric are in this material laminated against each other by hot melting. This filter material can be bought from the owner of the property right.

Material LT75: Laminate with the following structure: spunbonded fabric 17 g/m$^2$/staple fiber layer 75 g/m$^2$/spunbonded fabric 17 g/m$^2$. The layers are laminated by ultrasonic sound. For this, the lamination pattern Ungricht U4026 is used. This filter material can be bought from the owner of the property right.

PRIOR ART

The demands on vacuum cleaning apparatuses underwent a clear change in the past years.

The study by the "AEA Energy & Environment Group" by order of the "European Commission Energy" for defining the demands on an Eco Design for vacuum cleaners demonstrates that it would be desirable to reduce the input power to below 1100 W or even less in future from an energy-related point of view. The users of vacuum cleaning apparatuses, however, will expect that the cleaning effect will not considerably deteriorate compared to vacuuming appliances as they are available today with considerably higher input powers.

Customers' demands on the hygiene of a vacuum cleaning apparatus no longer only relate to a preferably low dust emission of the appliances but rather also to the hygienic disposal of the sucked-in dust.

In view of the filtration concept, a distinction can be made between vacuum cleaners without filter bag and vacuum cleaners with filter bag.

In vacuum-cleaners with filter bags, the air flow is more or less reduced as the filter bag is being loaded with dust. Approximately until the year 2000, filter bags of paper or of paper with a meltblown insert were mainly used. Being tested for the reduction of the maximum air flow with a partly filled dust container analogously to EN 60312, such paper filter bags exhibit an air flow drop of about 80% (or 60% if multilayer filter bags with a tissue insert are used).

After that, filter bags of non-woven fabrics slowly started to become accepted. Initially, filter bags with non-woven layers having a low dust storage capacity were used (SMS filter bags). By the introduction of filter bags of non-wovens with a capacity layer, the decrease of the air flow could be clearly reduced (see EP 0 960 645). Being tested for the reduction of the maximum air flow with a partly filled dust container analogously to EN 60312, such filter bags exhibit an air flow drop of about 30%.

Further improvements have been achieved by pre-filtration by loose fibers in the bag (DE 10 2007 060 747, DE 20 2007 010 692 and WO 2005/060807), or pre-separation by a bag within the bag (WO 2010/000453, DE 20 2009 002 970 U1, and DE 20 2006 016 303 U1). Redirections of flow or distributions of flow in the filter bag are suggested in EP 1 915 938, DE 20 2008 016 300, DE 20 2008 007 717 U1 (dust-storing insert), DE 20 2006 019 108 U1, DE 20 2006 016 304 U1, EP 1 787 560, and EP 1 804 635. Being tested for the reduction of the maximum air flow with a partly filled dust container analogously to EN 60312, an air flow drop of about 15% can be achieved with such filter bags. By this, further improvement of the suction power constancy is achieved.

European patent applications 10002964.4, 10163463.2, and 10163462.2 disclose an improved dust storage capacity by pleating the filter material or by providing the filter bag with so-called surface pleats. European patent application 10009351.7 shows how the suction power constancy can be improved by an optimized positioning of the bag in the vacuum cleaner. Being tested for the reduction of the maximum air flow with a partly filled dust container analogously to EN 60312, such filter bags exhibit an air flow drop of only about 5%.

In view of the hygienic disposal of the sucked-in dust, holding plates have been developed by means of which the filter bag is tightly closed manually, semi-automatically or automatically before it is removed from the vacuum cleaner (e.g. EP 2 012 640).

In vacuum cleaning apparatuses which are operated with a filter bag, the motor/fan unit is conventionally disposed behind the filter bag (in the downstream direction), i.e. the suction air is sucked by the motor/fan unit through the filter bag (so-called clean air principle). However, it is also possible to provide the motor/fan unit between the floor nozzle and the filter bag (so-called dirty air principle). In this case, the suction air still loaded with dirt is blown by the motor/fan unit into the filter bag.

Vacuum cleaners without bag—in particular cyclone vacuum cleaners—are characterized in that the air flow remains essentially constant as the dust collection container is being loaded with dust. The constant air flow of a cyclone vacuum cleaner is at first sight an advantage over vacuum cleaners with filter bags which are getting more or less clogged with an increasing loading of the filter bag, whereby the air flow is correspondingly reduced. However, this is achieved at the cost of a poor efficiency which consequently leads to cyclone vacuum cleaners having to comprise a high electric input power to produce a sufficient air flow. This high input power is required due to the high losses the filtration principle involves, meaning the loss for maintaining the high rotational speed of the dust-loaded air in the cyclone filter.

The low input power demanded in terms of energy policy together with an air flow leading to a still acceptable cleaning effect can be hardly realized with devices without filter bag.

Furthermore, in such vacuum cleaners without bag, the hygienic disposal of the sucked-in dust represents a problem.

In view of these disadvantages of the vacuum cleaner devices without bag, in the present document, only vacuum cleaning apparatuses with a vacuum cleaner and a filter bag are considered.

With such conventional vacuum cleaning apparatuses with filter bags, today an air flow of about 40 l/s can be realized with a moderate input power and with a newly inserted and empty filter bag. Such vacuum cleaners have an input power of about 1300 to 1400 W. If one wishes to achieve a higher air flow, higher input powers are required. If the input power is reduced, this also involves a considerable reduction of the air flow and thus the cleaning effect.

Table I indicates the quality factors $Q^W_{ion}$ and $Q^W_{teil}$ for vacuum cleaning apparatuses at present available with a vacuum cleaner and the filter bag provided by the manufacturer for these vacuum cleaners. These devices are floor-type vacuum cleaners with the nowadays common arrangement, that means with the filter bag being disposed upstream of the motor/fan unit. In the selection of the comparison examples, in particular such models have been chosen which are advertised by the manufacturers as being especially ecological and/or high-performing.

TABLE I

| Prior Art | $q_{un}$ [l/s] | $q_{teil}$ [l/s] | $P^{el}_{un}$ [W] | $P^{el}_{teil}$ [W] | $h^{saug}_{un}$ [kPa] | $h^{saug}_{teil}$ [kPa] | ψ [%] | $h^{tbar}_{un}$ [W] | $h^{bar}_{teil}$ [W] | $Q^{W}_{un}$ | $Q^{W}_{teil}$ |
|---|---|---|---|---|---|---|---|---|---|---|---|
| Miele S6240 | 40 | 36 | 1370 | 1299 | 1.70 | 1.16 | 87.0 | 7.2 | 11.4 | 20.5 | 8.9 |
| Miele S5 ecoline | 40 | 35 | 1350 | 1315 | 1.71 | 1.30 | 87.0 | 6.9 | 9.7 | 21.6 | 11.7 |
| Siemens Z6.0 Extrem green power | 37 | 30 | 904 | 851 | 1.51 | 0.96 | 62.0 | 4.2 | 8.0 | 22.3 | 7.4 |
| Siemens Z6.0 extreme power | 47 | 40 | 2091 | 2013 | 2.4 | 1.67 | 62.0 | 6.8 | 11.7 | 21.9 | 8.8 |
| AEG Öko Ultra One; S-bag classic long performance | 33 | 27 | 1043 | 998 | 1.20 | 0.78 | 32.0 | 5.8 | 10.4 | 6.6 | 2.4 |
| AEG Öko Ultra One: S-bag ultra long performance | 33 | 29 | 1040 | 1013 | 1.21 | 0.88 | 41.0 | 5.9 | 9.1 | 8.4 | 4.0 |
| Numatic Henry 1C | 31 | 28 | 1133 | 1100 | 1.04 | 0.82 | 84.0 | 8.4 | 9.4 | 10.4 | 7.4 |

As can be seen in Table I, $Q^{W}_{un}$ are within a range of below 7 to about 22, and $Q^{W}_{teil}$ correspondingly lower within a range of below 2 to about 12. It furthermore strikes that some vacuum cleaning apparatuses comprise a comparatively high quality factor for empty filter bags, but exhibit a comparatively low quality factor for partly filled filter bags.

It furthermore strikes that some vacuum cleaning apparatuses produce a comparatively high air flow, but that this is due to a poor filtration efficiency of the material of the filter bag. Such vacuum cleaners emit comparatively many dust particles to the environment.

Moreover, while there are vacuum cleaning apparatuses exhibiting a relatively low electric input power of the motor/fan unit, this is highly at the expense of the air flow, so that the cleaning effect of such vacuum cleaners is low.

DESCRIPTION OF THE INVENTION

In view of the above-mentioned disadvantages of prior art, the invention provides vacuum cleaning apparatuses with a vacuum cleaner and filter bags whose ecological efficiency is highly improved in such a way that $Q^{W}_{un}$ is greater than 25, preferably greater than 30, especially preferably greater than 30, and/or $Q^{W}_{teil}$ is greater than 13, preferably greater than 15, especially preferably greater than 17.

According to a preferred further development of the above described invention, the air flow $q_{un}$ can be greater than 30 l/s, preferably greater than 35 l/s, and especially preferably greater than 40 l/s.

By this, one can ensure that despite a highly reduced input power of the device according to the invention, a cleaning effect is achieved that is similar to that of the best vacuum cleaning apparatuses available today.

In the invention and in the above-mentioned further development, the air flow $q_{teil}$ can be greater than 26 l/s, preferably greater than 31 l/s, and especially preferably greater than 36 l/s.

Thereby, the high cleaning effect is ensured not only with the empty filter bag, but also during the continuous filling of the filter bag.

Furthermore, in the vacuum cleaning apparatus according to the invention, the measured vacuum $h^{saug}_{un}$ can be greater than 1.0 kPa, preferably greater than 1.3 kPa, and especially preferably greater than 1.7 kPa, and the measured vacuum $h^{saug}_{teil}$ can be greater than 0.7 kPa, preferably greater than 1 kPa, and especially preferably greater than 1.4 kPa.

This furthermore ensures that, despite a reduced input power of the device according to the invention, a cleaning effect can be achieved that is similar to that of the best vacuum cleaning apparatuses available today, and that the high cleaning effect does not only remain ensured with an empty filter bag, but also during the continuous filling of the filter bag.

Advantageously, the filtration efficiency of the filter bag material ψ of the filter bag used in the vacuum cleaning apparatus can be greater than 60%, preferably greater than 80%, especially preferably greater than 99%.

In this further development of the invention, it is ensured that the vacuum cleaning apparatus according to the invention only emits few particles to the environment despite its high ecological efficiency.

According to a completely different further development of the above described invention and its above described further developments, the vacuum cleaning apparatus can be designed such that the mean power input of the vacuum cleaning apparatus is lower than 1200 W, preferably lower than 800 W, and especially preferably lower than 400 W.

Hence, one can meet the increasingly higher demands in terms of energy saving with the vacuum cleaning apparatus.

The above described invention with its above described further developments can be particularly effectively employed in the field of household vacuum cleaning apparatuses, i.e. in particular with a filter bag volume of 1 l to 5 l in hand-held vacuum cleaners, in particular with filter bag volumes of 2 l to 7 l in floor-type vacuum cleaners, and in particular with a filter volume of 3 l to 15 l in upright vacuum cleaners.

In a particularly preferred further development, the filter bag of the vacuum cleaning apparatus can comprise surface pleats, in particular fixed dovetailed pleats. The filter bag-holding compartment can in this case in particular comprise bow-like ribs which keep the wall of the filter bag spaced apart from the wall of the filter bag-holding compartment and which are provided in such a way that they engage with the pleat valleys of the surface pleats.

According to another preferred further development, the filter bag-holding compartment of the vacuum cleaner can have a shape which approximately corresponds to the shape of the envelope of the filled filter bag.

By this further development, an optimal utilization of the filter area of the filter bag and an optimal filling of the filter bag during vacuum cleaning are ensured. It can thus be in particular avoided that the filter bag only insufficiently folds out in the filter bag-holding compartment.

BRIEF DESCRIPTION OF THE FIGURES

The figures serve to illustrate the prior art and the invention. In the drawings:

FIGS. 4*a* to 4*c* show schematic views of the filter bag-holding compartment for a flat bag without surface pleats according to a preferred embodiment of the vacuum cleaning apparatus according to the invention; in section B-B, only those bows adjacent to the blowing-in and blowing-out openings are shown for a better overview;

FIGS. 5*a* to 5*c* show schematic views of the filter bag-holding compartment for a flat bag with surface pleats according to a preferred embodiment of the vacuum cleaning apparatus according to the invention; in section B-B, only those bows adjacent to the blowing-in and blowing-out openings are shown for a better overview;

EMBODIMENTS OF THE INVENTION

The vacuum cleaning apparatus according to the invention comprises a filter bag-holding compartment adapted to the shape of the filter bag, in the present embodiment to the shape of a flat bag.

Here, a distinction must be made between two variants. The filter bag-holding compartment for a flat bag without surface pleats comprises at its inner sides small bow-like ribs which are intended to prevent that the filter material flatly nestles against the container wall and can no longer be flown through. The filter bag-holding compartment for flat bags with surface pleats is characterized by larger bow-like ribs which engage between the surface pleats of the filter bag to support the folding-out of the pleats. Apart from the bow-like ribs, the filter bag-holding compartment has the same dimensions for both embodiments.

Figure 7:
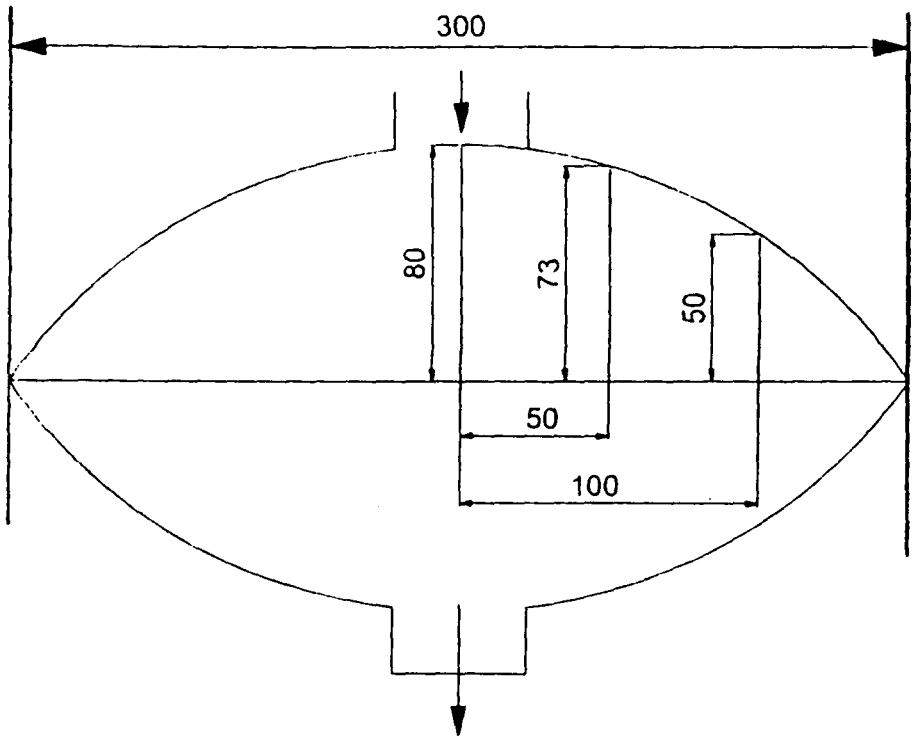
FIG. 7 shows a view of the filter bag-holding compartment for the preferred embodiments according to FIG. 4 and FIG. 5 in which the dimensioning for this filter bag-holding compartment is indicated.

FIGS. 4*a* to 4*c* are schematic representations of the filter bag-holding compartment for a filter bag without surface pleats. In FIG. 4*a*, the filter bag-holding compartment is shown in a plan view. In this plan view, it has the shape of a square with a side length of 300 mm. In FIG. 4*b* and FIG. 4*c*, sectional views along the lines A-A and B-B in FIG. 4*a* are shown. As can be seen in these figures, the filter bag-holding compartment has a largest height of 160 mm. In FIG. 7, further heights of the filter bag-holding compartment shown in FIG. 4 are indicated. The shape which the inner walls of the filter bag-holding compartment describe resembles the shape of a cushion. A flat bag without surface pleats, however, assumes exactly the shape of a cushion during the suction operation. It is also to be understood in this sense that the filter bag-holding compartment has a shape which approximately corresponds to the shape of the envelope of the filled filter bag.

In FIG. 4*a* to FIG. 4*c*, the bow-like ribs are designated with reference numeral 41. In this embodiment, all bow-like ribs 41 have a height h=10 mm. The bow-like shape of the ribs ensure a free circulation of the purified air in the filter bag-holding compartment.

Furthermore, FIG. 4*b* and FIG. 4*c* show a device in the form of a grid 42 which prevents the filter bag from being sucked into the outlet opening due to the suction flow in the latter.

FIGS. 5*a* to 5*c* are schematic representations of the filter bag-holding compartment for a filter bag with surface pleats. As already mentioned above, apart from the bow-like ribs, the dimensions of the filter bag-holding compartment are the same as for the filter bag-holding compartment according to FIG. 4 and FIG. 7. A flat bag with fixed surface pleats also assumes the shape of a cushion during the suction operation, so that the filter bag-holding compartment has a shape approximately corresponding to the shape of the envelope of the filled filter bag.

Furthermore, the filter bag-holding compartment has bow-like ribs 51 of different heights, as can be seen in particular in FIG. 5*b* and FIG. 5*c*. In this embodiment, too, a device in the form of a grid 52 is provided which prevents the filter bag from being sucked into the outlet opening due to the suction flow in the latter.

In FIG. 5*a* to FIG. 5*c*, moreover the measuring point where the vacuum in the filter bag-holding compartment is determined is designated with reference numeral 53.

Figure 1:
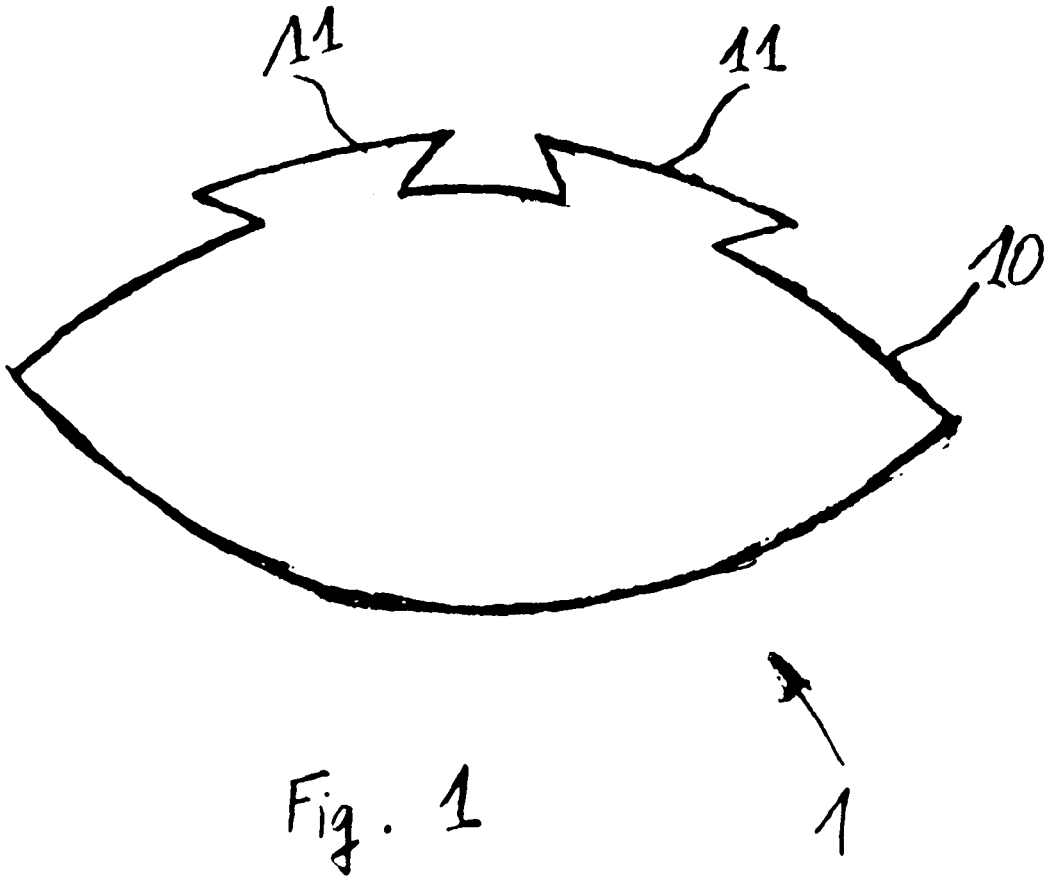
FIG. 1 shows a filter bag with surface pleats.
Figure 2:
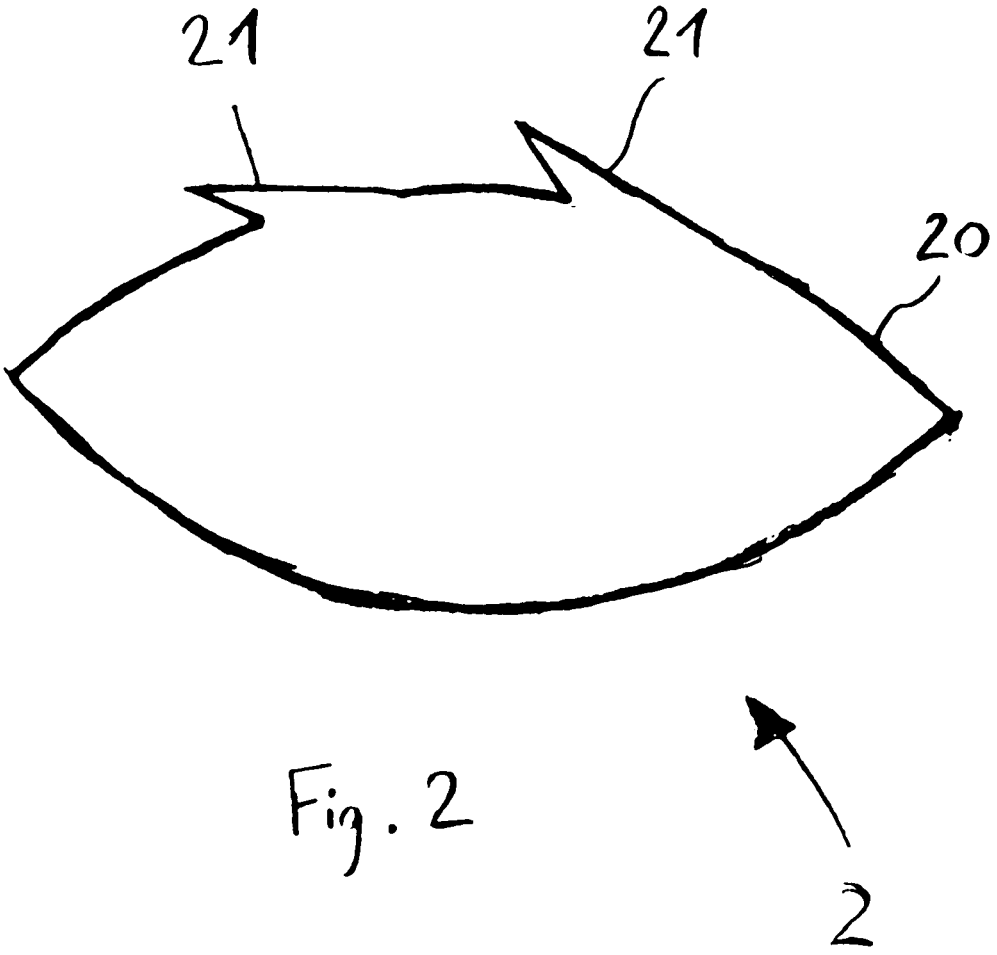
FIG. 2 shows a filter bag with surface pleats.
Figure 3B:
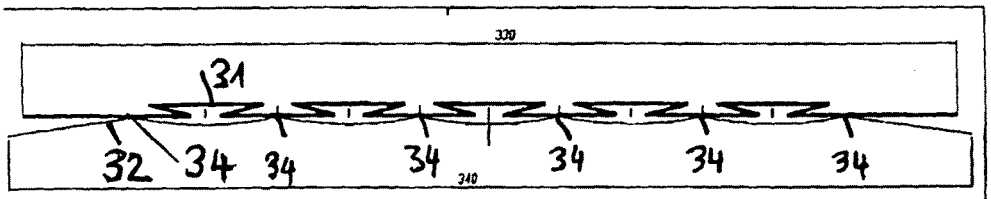
FIGS. 3*a* and 3*b* show schematic views of a filter material and a non-woven material web during the manufacture of filter material for filter bags with surface pleats in the form of fixed dovetailed pleats.
Figure 3A:
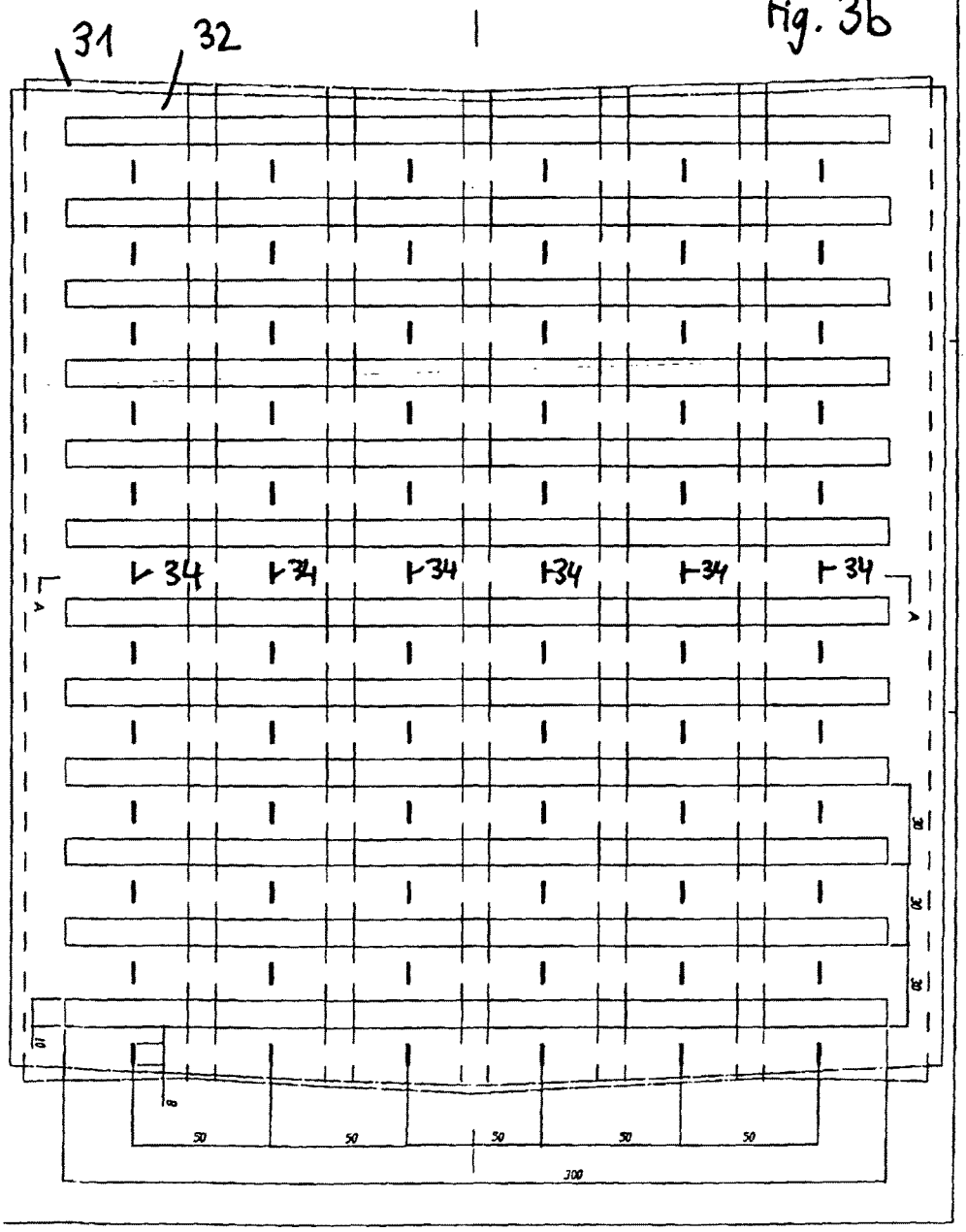
Figure 6:
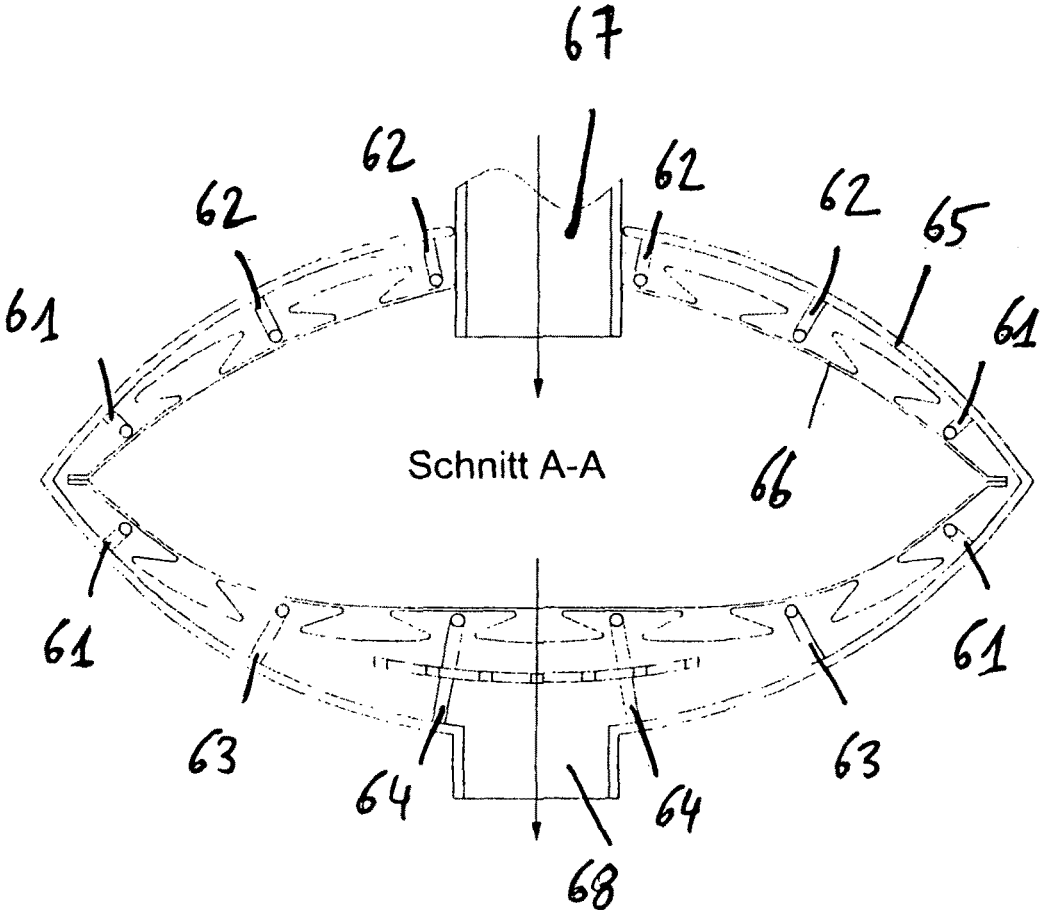
FIG. 6 shows a schematic view of the filter bag-holding compartment for a filter bag with surface pleats according to a preferred embodiment of the inventive vacuum cleaning apparatus corresponding to the sectional view A-A in FIG. 5*b* with an inserted filter bag.

FIG. 6 corresponds to FIG. 5*b*, where a filter bag with fixed surface pleats in the form of dovetailed pleats is inserted. The bow-like ribs are designated with reference numerals 61, 62, 63 and 64. These ribs engage between the surface pleats of the filter bag and thus contribute to the folding-out of the surface pleats. This is schematically shown in FIG. 6. Simultaneously, the filter bag wall is held at a distance to the wall of the filter bag-holding compartment to thus ensure a flow through the complete filter area of the filter bag. The bow-like ribs 61 have a height h=10 mm, the ribs 62=15 mm, the ribs 63=20 mm, and the ribs 64=35 mm. By the ribs being interrupted, a free circulation of the purified air in the filter bag-holding compartment is ensured.

Reference numeral 65 designates in this FIG. 6 the wall of the filter bag-holding compartment. The inserted filter bag 66 comprises several surface pleats which are schematically represented as being partly folded out. The air to be purified is sucked into the filter bag through the inlet opening 67 and sucked off via the outlet of the filter bag-holding compartment 68. There is furthermore a grid in front of the outlet opening 68 which prevents the filter bag from blocking the outlet opening.

Figure 8:
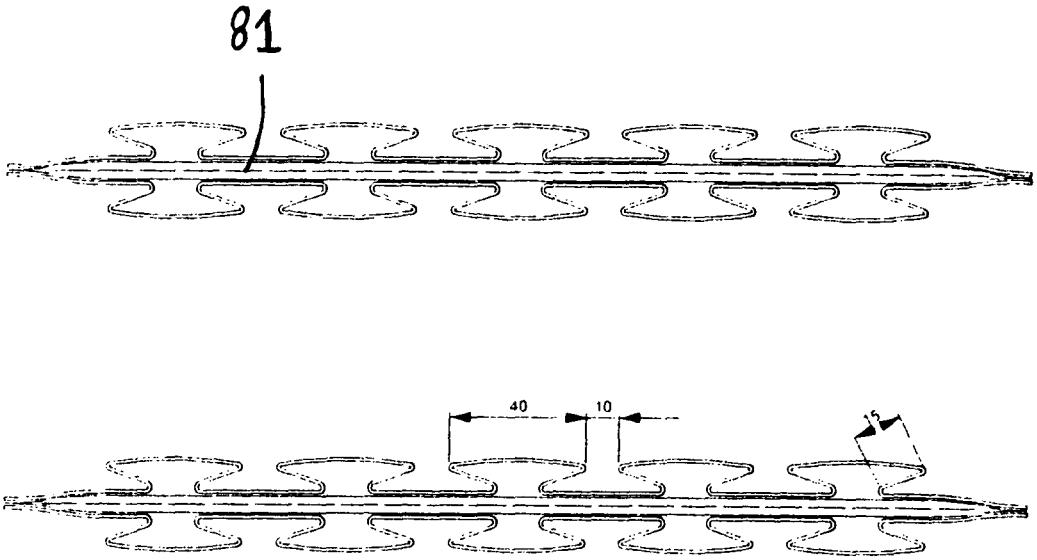
FIG. 8 shows a cross-sectional view of a filter bag with surface pleats of the vacuum cleaning apparatus according to the invention in which the dimensioning of the surface pleats is indicated.

According to the invention, flat bags with or without surface pleats can be inserted. In FIG. 8, a section of such a flat bag with surface pleats is represented with indications of the sizes of the surface pleats. The flat bags with and without surface pleats which were inserted for the tests for Table II had dimensions of 290×290 mm. Furthermore, one can see in FIG. 8 the diffuser of LT75 with reference numeral 81.

All filter bags with surface pleats of Table II were equipped with diffusers. These consisted of 22 strips of a width of 11 mm and a length of 290 mm. As a material for the diffusers, LT75 was used.

As a motor/fan unit, a Domel KA 467.3.601-4 was used in the device according to the invention. The suction opening of the motor/fan unit was directly connected with the blowing-out opening of the filter bag-holding compartment. By control of the mains voltage by means of a transformer, the air flow required for the test (as vacuum in the measuring box) was set with the filter bag being empty. This mains voltage was maintained for the respective series of tests where 400 g of DMT 8 dust was sucked in in portions of 50 g. The resulting electric input power was measured. No blowing-out filter was used.

Table II shows the results of the measurements for different devices according to the invention with the above described filter bag-holding compartment and the above described motor/fan unit. Here, both filter bags with surface pleats and flat bags without surface pleats were employed. As a material for the employed filter bags with/without surface pleats, laminates CS50, SMS92, and LT75 as indicated in Table II and manufactured by the owner of the property right were used.

As can be directly taken from Table II, all devices according to the invention have values for $Q^W_{un}$ within a range of 30.1 to 31.1. So, these values are far above the values known from prior art (here, the highest value was 22.3). The values for $Q^W_{teil}$ are within a range of 7.3 to 15.1. If one desists from the values for the flat bags of SMS, the least preferred material, a range of 16.8 to 25.1 results which is also far above the range of devices known from prior art (here, the highest value was 11.7).

One can furthermore take from Table II that the device according to the invention is superior over prior art in that one can obtain a high air flow with a comparatively low power input. For example, in Siemens Z6.0 extrem green power, the electric input power of 904 W is converted into an air flow of 37.2 l/s, whereas according to the invention, an electric input power of only 492 W is required for obtaining an air flow of 37.9 l/s.

Table II moreover shows that devices with filter bags with surface pleats are ecologically more efficient than filter bags without surface pleats, although with the latter, too, very high quality factors can be achieved. This ecological efficiency is higher the more dust has been sucked in, as one can see by the quality factors for the partly filled filter bags.

Filter bags of the SMS material can be also employed according to the invention especially with high air flows. However, one can immediately see from Table II that the filter material CS50 is far superior over this SMS92 material under the aspect of ecological efficiency.

TABLE II

| Vacuum cleaning apparatuses according to the invention | $q_{un}$ [l/s] | $q_{teil}$ [l/s] | $P^{el}_{un}$ [W] | $P^{el}_{teil}$ [W] | $h^{saug}_{un}$ [kPa] | $h^{saug}_{teil}$ [kPa] | ψ [%] | $P^{tbar}_{un}$ [W] | $P^{tbar}_{teil}$ [W] | $Q^W_{un}$ | $Q^W_{teil}$ |
|---|---|---|---|---|---|---|---|---|---|---|---|
| Filter bags with surface pleats of CS50 and diffusor of LT75 | 53 | 48 | 1251 | 1231 | 3.05 | 2.50 | 85.0 | 8.1 | 9.7 | 32.0 | 21.9 |
| | 52 | 47 | 1165 | 1148 | 2.90 | 2.42 | 85.0 | 7.7 | 8.2 | 32.0 | 25.1 |
| | 50 | 46 | 1085 | 1068 | 2.75 | 2.33 | 85.0 | 7.4 | 8.6 | 31.6 | 23.0 |
| | 49 | 44 | 994 | 974 | 2.60 | 2.13 | 85.0 | 6.9 | 8.3 | 32.0 | 21.8 |
| | 48 | 43 | 900 | 891 | 2.45 | 2.00 | 85.0 | 6.5 | 7.8 | 32.0 | 21.8 |
| | 46 | 42 | 827 | 813 | 2.30 | 1.89 | 85.0 | 6.1 | 7.3 | 32.0 | 22.0 |
| | 45 | 40 | 760 | 739 | 2.15 | 1.75 | 85.0 | 5.7 | 6.9 | 32.1 | 21.6 |
| | 43 | 39 | 690 | 674 | 2.00 | 1.64 | 85.0 | 5.4 | 6.5 | 31.5 | 21.4 |
| | 41 | 37 | 620 | 599 | 1.85 | 1.45 | 85.0 | 4.9 | 6.1 | 32.1 | 20.2 |
| | 40 | 36 | 551 | 540 | 1.70 | 1.39 | 85.0 | 4.6 | 5.6 | 31.4 | 21.1 |
| | 38 | 34 | 492 | 473 | 1.55 | 1.22 | 85.0 | 4.2 | 5.2 | 31.4 | 19.9 |
| | 36 | 32 | 429 | 414 | 1.40 | 1.08 | 85.0 | 3.8 | 4.7 | 31.3 | 19.5 |
| | 34 | 29 | 364 | 354 | 1.25 | 0.91 | 85.0 | 3.4 | 4.3 | 31.3 | 18.0 |
| | 32 | 28 | 309 | 302 | 1.10 | 0.82 | 85.0 | 3.0 | 3.8 | 31.2 | 18.3 |
| | 30 | 26 | 261 | 252 | 0.95 | 0.71 | 85.0 | 2.6 | 3.4 | 31.1 | 17.8 |
| | 26 | 23 | 201 | 193 | 0.75 | 0.57 | 85.0 | 2.0 | 2.6 | 31.9 | 18.6 |
| Flat bags of SMS92 | 26 | 17 | 212 | 201 | 0.75 | 0.31 | 85.0 | 2.1 | 3.6 | 30.4 | 7.3 |
| | 40 | 32 | 580 | 548 | 1.7 | 0.83 | 85.0 | 4.8 | 7.6 | 30.1 | 9.3 |
| | 53 | 38 | 1314 | 1235 | 3.05 | 1.6 | 85.0 | 8.4 | 12.9 | 30.9 | 10.5 |
| Flat bags of CS50 | 53 | 45 | 1328 | 1286 | 3.05 | 2.18 | 85.0 | 8.4 | 11.0 | 30.9 | 16.8 |

The invention claimed is:

1. A vacuum cleaning apparatus, comprising a vacuum cleaner and a flat filter bag, the vacuum cleaner comprising a filter bag-holding compartment having a shape approximately corresponding to a shape of an envelope of the filter bag when the filter bag is filled, the filter bag-holding compartment having an inlet opening and an outlet opening, the filter bag-holding compartment comprising a plurality of protrusions that keep at least a portion of a wall of the filter bag spaced apart from a wall of the filter bag-holding compartment, wherein the vacuum cleaning apparatus has a quality factor with an empty filter bag $Q^W_{un}$ defined by $$Q^W_{un}=(h^{saug}_{un}/h^{fbar}_{un})*\psi$$

where $h^{saug}_{un}$: vacuum according to EN 60312 of the vacuum cleaning apparatus with the empty filter bag in [kPa], $h^{fbar}_{un}$: vacuum in the filter bag-holding compartment with the empty filter bag in [kPa], ψ: filtration efficiency of the filter bag material in [%]

which is greater than 25 or the vacuum cleaning apparatus has a quality factor with a partly filled filter bag $Q^W_{teil}$ defined by $$Q^W_{teil}=(h^{saug}_{teil}/h^{fbar}_{teil})*\psi$$

where $h^{suag}_{teil}$: vacuum according to EN 60312 of the vacuum cleaning apparatus with the partly filled filter bag in [kPa], $h^{fbar}_{teil}$: vacuum in the filter bag-holding compartment with the partly filled filter bag in [kPa], and ψ: filtration efficiency of the filter bag material in [%] which is greater than 13.

2. The vacuum cleaning apparatus according to claim 1, wherein an air flow with the empty filter bag is greater than 30 l/s.

3. The vacuum cleaning apparatus according to claim 1, wherein an air flow with the partly filled filter bag is greater than 26 l/s.

4. The vacuum cleaning apparatus according to claim 1, wherein the vacuum $h^{saug}_{un}$ is greater than 1.0 kPa.

5. The vacuum cleaning apparatus according to claim 1, wherein the vacuum $h^{saug}_{teil}$ is greater than 0.7 kPa.

6. The vacuum cleaning apparatus according to claim 1, wherein the filtration efficiency of the filter bag material $\psi$ is greater than 60%.

7. The vacuum cleaning apparatus according to claim 1, wherein a mean power input of the vacuum cleaning apparatus is smaller than 1200 W.

8. The vacuum cleaning apparatus according to claim 1, wherein the vacuum cleaning apparatus comprises a filter bag volume of 1 l to 5 l in hand-held vacuum cleaners, a filter bag volume of 2 l to 7 l in floor-type vacuum cleaners, or a filter bag volume of 3 l to 15 l in upright vacuum cleaners.

9. The vacuum cleaning apparatus according to claim 1, wherein the filter bag comprises surface pleats.

10. The vacuum cleaning apparatus according to claim 9, wherein the protrusions comprise bow-like ribs which keep the at least the portion of the wall of the filter bag spaced apart from the wall of the filter bag-holding compartment and the ribs engage in pleat valleys of the surface pleats.

11. The vacuum cleaning apparatus according to claim 1, wherein the quality factor with the empty filter bag $Q^{W}_{un}$ is greater than 30.

12. The vacuum cleaning apparatus according to claim 1, wherein the quality factor with the partly filled filterbag $Q^{W}_{teil}$ is greater than 17.

13. The vacuum cleaning apparatus according to claim 1, wherein an air flow with the empty filter bag is greater than 40 l/s.

14. The vacuum cleaning apparatus according to claim 1, wherein an air flow with the partly filled filter bag is greater than 36 l/s.

15. The vacuum cleaning apparatus according to claim 1, wherein the vacuum $h^{saug}_{un}$ is greater than 1.7 kPa.

16. The vacuum cleaning apparatus according to claim 1, wherein the vacuum $h^{saug}_{teil}$ is greater than 1.4 kPa.

17. The vacuum cleaning apparatus according to claim 1, wherein the filtration efficiency of the filter bag material $\psi$ is greater than 80%.

18. The vacuum cleaning apparatus according to claim 1, wherein a mean power input of the vacuum cleaning apparatus is smaller than 400 W.

19. The vacuum cleaning apparatus according to claim 1, wherein the filter bag comprises fixed dovetailed pleats.

* * * * *